US006633118B1

(12) United States Patent
Yamamoto et al.

(10) Patent No.: US 6,633,118 B1
(45) Date of Patent: Oct. 14, 2003

(54) ELECTRON-EMITTING DEVICE, ELECTRON SOURCE USING THE ELECTRON-EMITTING DEVICE, AND IMAGE-FORMING APPARATUS USING THE ELECTRON SOURCE

(75) Inventors: Keisuke Yamamoto, Yamato; Tamaki Kobayashi, Isehara; Satoshi Mogi, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/513,135

(22) Filed: Feb. 25, 2000

(30) Foreign Application Priority Data

Feb. 26, 1999 (JP) ..... 11-052014
Feb. 15, 2000 (JP) ..... 2000-041455

(51) Int. Cl.[7] ..... H01J 1/62
(52) U.S. Cl. ..... 313/495; 313/336; 313/310
(58) Field of Search ..... 313/495, 496, 313/497, 310, 336, 351, 238, 292, 243, 240, 250, 609, 610, 621

(56) References Cited

U.S. PATENT DOCUMENTS 5,470,265 A 11/1995 Nomura et al. ..... 445/24
5,530,314 A * 6/1996 Banno et al. ..... 313/310
5,578,897 A 11/1996 Nomura et al. ..... 313/310
6,208,071 B1 * 3/2001 Nishimura et al. ..... 313/495

FOREIGN PATENT DOCUMENTS

EP 0 660 357 6/1995
JP 7-235255 9/1995
JP 2854385 11/1998

OTHER PUBLICATIONS

M.I. Elinson et al., "The Emission of Hot Electrons and The Field Emission of Electrons From Tin Oxide", Radio Engineering and Electronic Physics, Jul. 1965, pp. 1290–1296.
H. Araki, "Electroforming and Electron Emission of Carbon Thin Films", Journal of the Vacuum, Society of Japan, 1983, pp. 22–29 (with English Abstract on p. 22).
G. Dittmer, "Electrical Conduction and Electron Emission of Discontinuous Thin Films", Thin Solid Films, 9, 1972, pp. 317–328.
M. Hartwell, "Strong Electron Emission From Patterned Tin–Indium Oxide Thin Films", IEDM, 1975, pp. 519–521.

* cited by examiner

*Primary Examiner*—Sandra O'Shea
*Assistant Examiner*—Bao Truong
(74) *Attorney, Agent, or Firm*—Fitzpatrick, Cella, Harper & Scinto

(57) ABSTRACT

An electron-emitting device includes, a pair of electroconductors disposed on a substrate so as to face each other, and a pair of deposit films connected to the pair of electroconductors, respectively, disposed with a gap therebetween and mainly containing carbon. Lead is contained in the deposit films in a rate of from 1 mol % to 5 mol %% with respect to carbon.

16 Claims, 9 Drawing Sheets

ELECTRON-EMITTING DEVICE, ELECTRON SOURCE USING THE ELECTRON-EMITTING DEVICE, AND IMAGE-FORMING APPARATUS USING THE ELECTRON SOURCE

BACKGROUND OF THE INVENTION

1. Field of the Invention

The present invention relates to an electron-emitting device, an electron source formed of the electron-emitting device and an image-forming apparatus such as a display device to which the electron source is applied, and more particularly to a surface conduction electron-emitting device with a novel structure, an electron source formed of the surface conduction electron-emitting device, and an image-forming apparatus such as a display device to which the electron source is applied.

2. Related Background Art

The surface conduction electron-emitting device utilizes a phenomenon in which a current is made to flow in an electroconductive film formed on a substrate to emit electrons.

As examples of the surface conduction electron-emitting device, there have been reported a surface conduction electron-emitting device using an $SnO_2$ film (M. I. Elinson Radio Eng. Electron Phys., 10, 1290, (1965)), a surface conduction electron-emitting device using an Au thin film (G. Ditmmer, Thin Solid Films, 9,317 (1972)), a surface conduction electron-emitting device using an $In_2O_3/SnO_2$ thin film (M. Hartwell and C. G. Fonsted, IEEE Trans. ED Conf., 519 (1975)), a surface conduction electron-emitting device using a carbon thin film (Hisashi Araki, et al: Vacuum, Vol. 26, No. 1, P. 22 (1983)), and so on.

In those surface conduction electron-emitting devices, generally an energization operation called "forming" is conducted on the electroconductive film before electron emission to come to a state in which electrons are emitted.

In the specification, the term "forming" means that a constant voltage, or a voltage that slowly rises at a rate of, for example, about 1 V/min, is applied to both ends of the electroconductive film so that a current flows in the electroconductive film with the result that the electroconductive film is locally destroyed, deformed or affected into an electrically high resistant state by which electron emission occurs.

It is presumed that the above operation permits the electroconductive film to be partially fissured, and a phenomenon of the electron emission is caused by the existence of the fissure. Where the electron emission actually occurs is not completely elucidated, but the fissure portion and a region surrounding the fissure portion may be called "electron-emitting portion" for convenience.

The applicant of the present invention has already proposed many types of surface conduction electron-emitting devices. For example, that the above "forming" operation is preferably conducted by applying a pulse voltage to the electroconductive film has been disclosed in Japanese Patent No. 2854385, U.S. Pat. Nos. 5,470,265, 5,578,897, and so on.

In this example, the waveforms of the pulse voltage may be produced by a method in which peak values are held constant as shown in FIG. 5A, or a method in which the peak values are gradually increased. Thus, the waveforms can be appropriately selected taking the configuration and the material of the device, the forming conditions and so on into consideration.

Also, there has been proved that the pulse voltage is repeatedly applied to the electron-emitting device in an atmosphere containing an organic material therein subsequently to the above forming operation, as a result of which a current that flows in the device (device current If) and a current produced with electron emission (emission current Ie) are increased. This operation is called "activation".

The above operation is that a deposit mainly containing carbon therein is formed in a region including the fissure formed in the electroconductive film through the forming operation, which is disclosed in detail in Japanese Patent Application Laid-Open No. 7-235255, etc.

In the case where the above-described surface conduction electron-emitting device is applied to an image-forming apparatus or the like, a lower power consumption and a higher luminance are further demanded.

Accordingly, as the performance of the electron-emitting device, a demand has been made to heighten the ratio of the emission current Ie to the device current If, that is, the electron emission efficiency as compared with that in the conventional device.

Also, it is needless to say that in improving the above performance, a change of the performance with a time which results from continuing the electron emission must be prevented from increasing more than that in the conventional device.

SUMMARY OF THE INVENTION

An object of the present invention is to provide an electron-emitting device excellent in the electron emission characteristic, an electron source using the electron-emitting device, and an image-forming apparatus using the electron source.

In order to achieve the above object, according to the present invention, there is provided an electron-emitting device comprising: a substrate; a pair of electroconductors disposed on a substrate so as to face each other; and a pair of deposit films connected to the pair of electroconductors, respectively, disposed with a gap therebetween and mainly containing carbon, wherein lead is contained in the deposit films in a rate of from 1 mol % to 5 mol % with respect to carbon.

Also, according to the present invention, there is provided an electron-emitting device comprising: a pair of device electrodes disposed on a substrate so as to face each other; electroconductive films connected to the pair of device electrodes and having a fissure between the pair of device electrodes; and a deposit film formed in the fissure and on a region including the fissure, having a gap narrower in width than that of the fissure within the fissure and mainly containing carbon, wherein lead is contained in the deposit film in a rate of from 1 mol % to 5 mol % with respect to carbon.

DESCRIPTION OF THE PREFERRED EMBODIMENTS

According to the present invention, there is provided an electron-emitting device comprising: a pair of electroconductors disposed on a substrate so as to face each other; and a pair of deposit films connected to the pair of electroconductors, respectively, disposed with a gap therebetween and mainly containing carbon, wherein lead is contained in the deposit films in a rate of from 1 mol % to 5 mol % with respect to carbon.

Also, according to the present invention, there is provided an electron-emitting device comprising: a pair of device electrodes disposed on a substrate so as to face each other; electroconductive films connected to the pair of device electrodes and having a fissure between the pair of device electrodes; and a deposit film formed in the fissure and on a region including the fissure, having a gap narrower in width than that of the fissure within the fissure and mainly containing carbon, wherein lead is contained in the deposit film in a rate of from 1 mol % to 5 mol % with respect to carbon.

Further, according to the present invention, there is provided an electron source comprising: the plurality of electron-emitting devices disposed on a substrate; and wirings connected to those electron-emitting devices.

Still further, according to the present invention, there is provided an image-forming apparatus comprising: the electron source and an image-forming member for forming an image by collision of electrons emitted from the electron source.

Hereinafter, a description will be given in detail of a preferred embodiment of the present invention as one example with reference to the accompanying drawings. The scope of the present invention is not limited by only the dimensions, the material, the configuration and the relative arrangement of the structural parts described in this embodiment so far as being not specifically described.

Figure 1A:
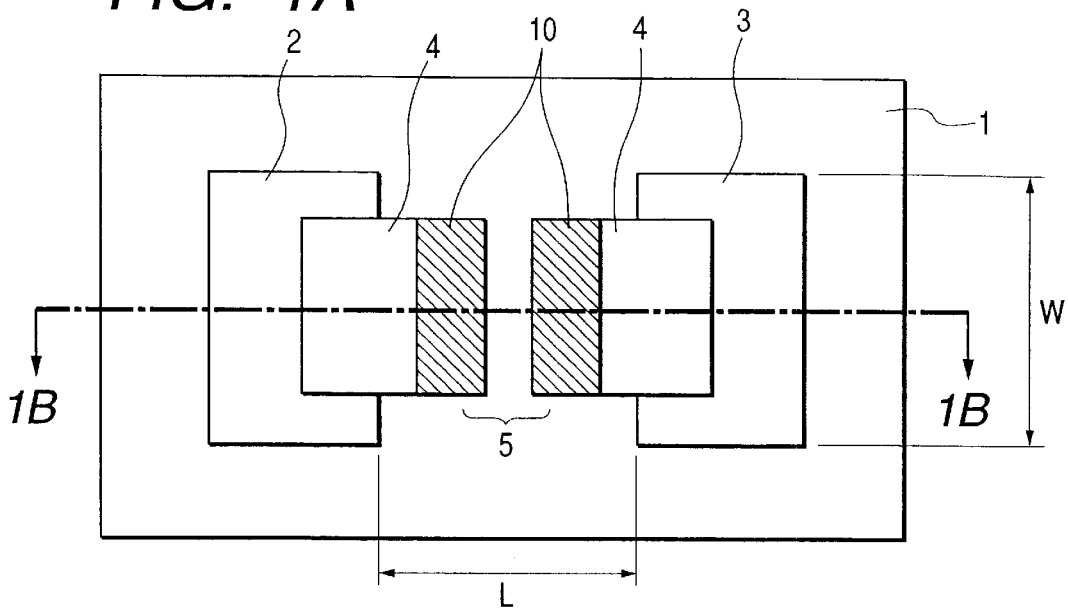
FIGS. 1A and 1B are schematic diagrams showing the rough structure of an electron-emitting device in accordance with an embodiment of the present invention.
Figure 1B:
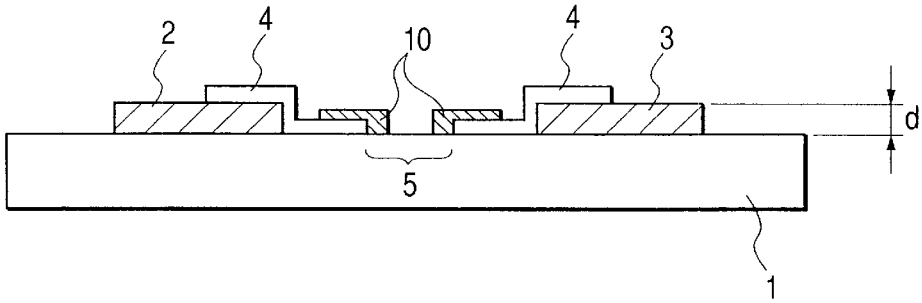

First, referring to FIGS. 1A and 1B, a description will be described of the basic structure of an electron-emitting device in accordance with an embodiment of the present invention. FIGS. 1A and 1B are schematic diagrams showing the rough structure of an electron-emitting device in accordance with an embodiment of the present invention, in which FIG. 1A is a schematic plan view thereof and FIG. 1B is a schematic cross-sectional view thereof (a cross-sectional view taken along a line 1B—1B in FIG. 1A).

Referring to FIGS. 1A and 1B, reference numeral 1 denotes a substrate made of an insulating material as a base, and a pair of device electrodes 2 and 3 are disposed on the substrate 1 so as to face each other. Also, electroconductive films 4 are disposed so as to be connected to the pair of device electrodes 2 and 3.

The example shown in the figure shows a case in which an electroconductor is formed of the device electrodes 2, 3 and the electroconductive film 4 as described above. Alternatively, even if the electroconductor may be formed of only the device electrodes 2 and 3 with elimination of the electroconductive film 4, the same function can be exhibited as the electron-emitting device.

In the figures, reference numeral 5 schematically shows fissures formed on the electroconductive films 4, and the fissures 5 are disposed between the pair of device electrodes 2 and 3.

In the figures, reference numeral 10 denotes a deposit (deposit film) which mainly contains carbon. In this example, the deposits 10 shown in the figures is formed on only the electroconductive films 4. However, the deposits 10 may be also formed on the device electrodes 2 and 3 depending on the forming method. Also, the deposit 10 may be formed on the substrate 1 except inside the fissure 5.

The deposits 10 that mainly contain carbon are formed not only around the fissure 5 but also within the fissure 5. The deposits 10 are formed within the fissure 5 so as to have a gap 6 narrower than the fissure 5.

Figure 2:
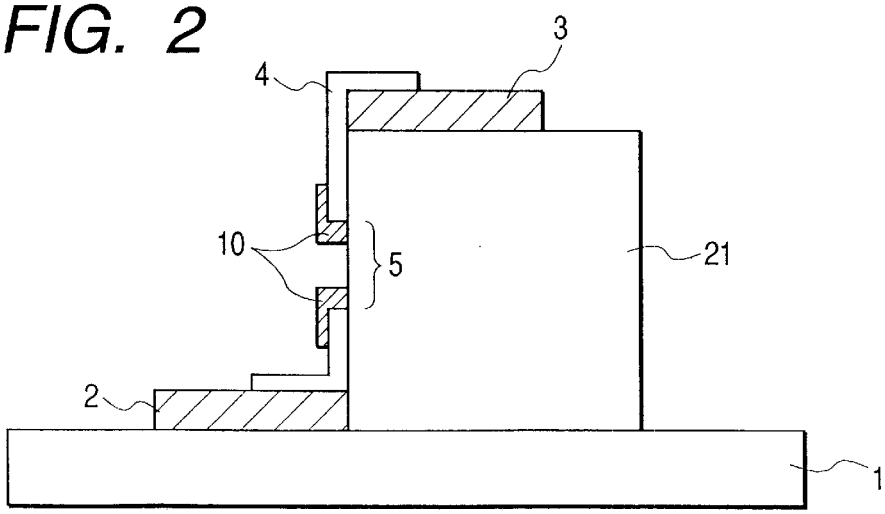
FIG. 2 is a cross-sectional view schematically showing the electron-emitting device in accordance with the embodiment of the present invention.

As another basic structure of the electron-emitting device, there is a step type electron-emitting device. FIG. 2 is a cross-sectional view schematically showing the electron-emitting device in accordance with the embodiment of the present invention.

In the figure, reference numeral 21 denotes a step-forming member made of an insulating material which is disposed on the substrate 1 in order to form a step. Other basic structures and so on are identical with those shown in FIGS. 1A and 1B and denoted by the same references.

In this example, as the property demanded for the above device electrodes 2 and 3, those device electrodes 2 and 3 need to have sufficient conductivity, and the material may be metal, alloy, electroconductive metal oxide, printed conductor made of a mixture of those material and glass or the like, semiconductor, etc.

In order to preferably conduct the formation of a fissure through the forming operation, that is, in order to preferably give the electron-emitting performance, it is preferable to form the electroconductive film 4 by the fine particles of the electroconductive material. For example, electroconductive material such as Ni, Au, PdO, Pd or Pt can be employed as the material.

Of those materials, PdO is a proper material because of the following advantages. That is, an electroconductive film formed of fine particles can be easily formed by burning an organic Pd compound film which has been formed from PdO in the atmosphere. Also, because PdO is of semiconductor, it is relatively lower in electric conductivity than metal and readily controllable so as to obtain an appropriate resistant value for forming. Further, since PdO can be relatively readily reduced, it is changed into metal Pd after a fissure has been formed through forming, to thereby make it possible to reduce the resistor.

The formation of the deposit 10 which mainly contains carbon therein can be conducted by the above-described "activation" method.

The amount of lead contained in the deposit 10 mainly containing carbon therein (hereinafter referred to as "Pb") can be controlled by a method in which a raw gas containing Pb therein is further introduced into the atmosphere containing the organic material therein when activation is conducted, to control the amount of introduced raw gas, or a method in which a solvent containing Pb in the form of an organic metal compound therein is coated on the deposit which has been formed, and a heat operation is conducted on the coated solvent so that Pb is allowed to be contained in the deposit 10, to thus controlling the amount of coated solvent.

According to the present inventors' study, there has been found that the effect of improving the electron emission efficiency is obtained if the ratio of Pb to carbon is 1 mol % or more.

On the other hand, there has been found that in the case where the content of Pb is too high, if electron emission is continuously conducted, a rate at which the emission current is reduced becomes higher than that in a case where Pb is not contained in the deposit 10 (that is, the stabilization is lowered). In view of this, the present inventors have found that the stability is not actually adversely affected if the content of Pb with respect to carbon is 5 mol % or less, and have attained the present invention.

The above reason is not sufficiently understood. However, the present inventors have presumed that Pb is separated in the deposit mainly containing carbon therein to enhance the electric conductivity which advantageously acts in an improvement of the electron emission efficiency. Also, it is presumed that the reason why the stability is adversely affected by an increase in the content of Pb is that the thermal stability deteriorates because the melting point of Pb is low.

Subsequently, a more specific embodiment structured on the basis of the above embodiment of the present invention will be described.

(Embodiment of Electron-Emitting Device)

An electron-emitting device according to this embodiment is identical in structure with that shown in FIG. 1 which has been described in advance.

A method of manufacturing the electron-emitting device according to this embodiment will be described with reference to FIGS. 1A, 1B and FIGS. 3A to 3D.

(Step-a)

First, a photoresist pattern is formed on a quartz substrate 1 which has been cleaned so as to provide openings corresponding to the configuration of the device electrodes 2 and 3, and Ti 5 nm in thickness and Pt 30 nm in thickness are sequentially deposited thereon through the vacuum evaporation method.

Figure 3A:
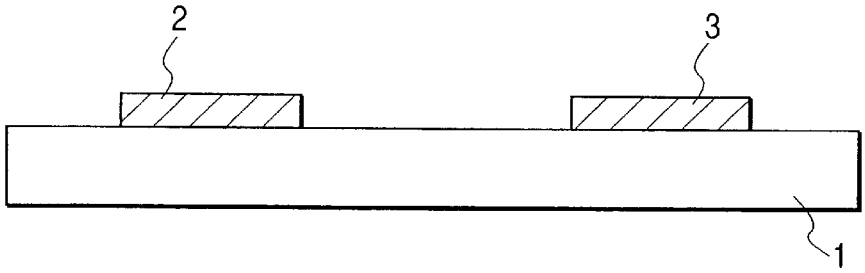
FIGS. 3A, 3B, 3C and 3D are explanatory diagrams showing a manufacturing process of the electron-emitting device in accordance with the embodiment of the present invention.

Then, the photoresist pattern is melted by an organic solvent so as to be removed and electrodes, each formed of a Pt/Ti laminate film, are formed through a lift-off manner. In this example, an electrode interval L is 50 $\mu$m, and an electrode width W is 300 $\mu$m (FIG. 3A).

(Step-b)

A Cr film is formed in thickness of 100 nm through the vacuum evaporation method, and is then patterned so as to provide an opening corresponding to the configuration of the electroconductive film which will be described later through the photolithography method. Thereafter, an organic Pd compound solvent (ccp4230 made by Okuno Chemicals Corp.) is coated on the surface by means of a spinner, and after the coated solvent is dried, a heat operation is conducted on the dried solvent in the atmosphere at 350° C. for 12 minutes.

With the above processing, an electroconductive film formed of PdO fine particles and having a thickness of 10 nm is formed. The sheet resistance Rs of that film is $2\times10^4$ Ω/□.

The sheet resistance Rs is directed to the amount represented as R=(1/w)Rs when a current is made to flow in a film having a length l and a width w in a longitudinal direction, and the measured resistant value is R. If the film is uniform, assuming that the resistivity is ρ and the film thickness is t, the sheet resistance Rs is represented by Rs=ρ/t.

(Step-c)

Figure 3B:
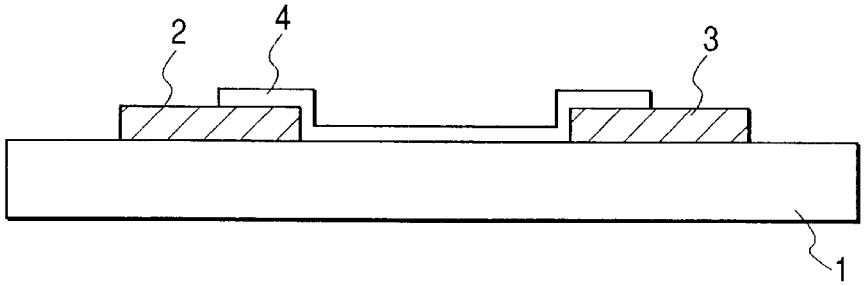

The above Cr film is removed by Cr etchant, and the electroconductive film is patterned into a desired configuration through the lift-off manner (FIG. 3B).

(Step-d)

Figure 3C:
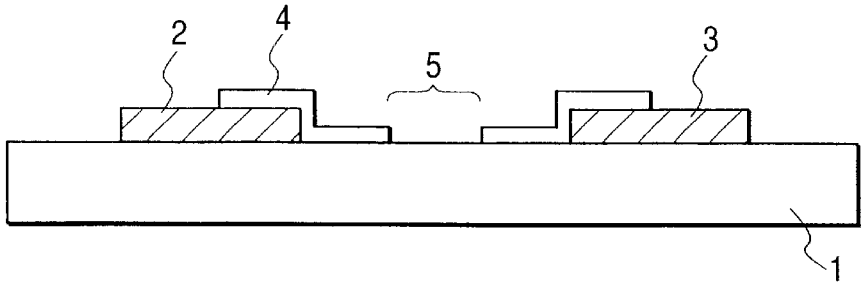

The above device is located within a vacuum processing device, and a pressure within a vacuum vessel is reduced to $2.7\times10^{-4}$ Pa by a gas exhaust device. Thereafter, a pulse voltage is applied between the device electrodes 2 and 3 to conduct a forming operation and a fissure 5 is partially formed in the electroconductive film (FIG. 3C).

Figure 5A:
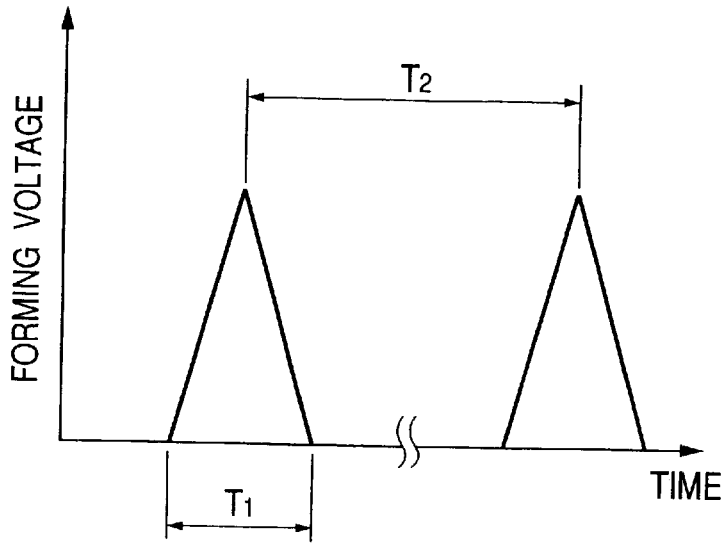
FIGS. 5A and 5B are waveform diagrams showing pulse voltages used in a forming step in manufacturing the electron-emitting device in accordance with the embodiment of the present invention.
Figure 5B:
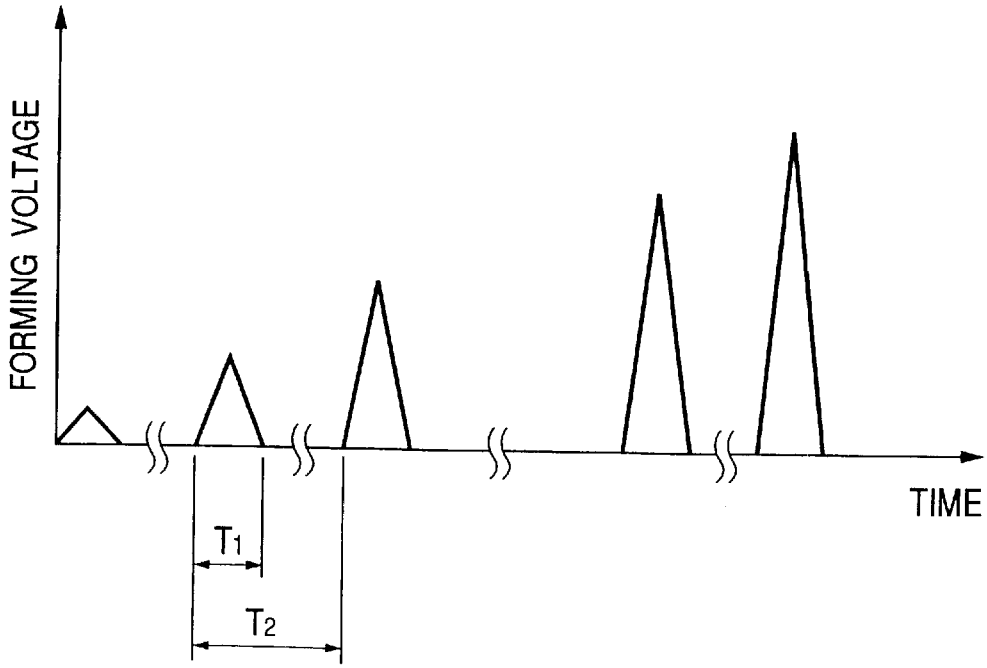

The waveform of the pulse voltage used for the forming operation is shown in FIG. 5B, in which the pulse width Ti is 1 msec, and the pulse interval T2 is 10 msec. The peak value is gradually increased by a step of 0.1 V to conduct the forming operation.

During the forming operation, a rectangular wave pulse 0.1 V in peak is inserted between the above pulses, and the current value is measured, to thus obtain the resistant value of the device. At the time where the resistant value thus obtained exceeds 1 MΩ, the application of pulses stops to complete the forming operation.

(Step-e)

Subsequently, an activation step is conducted. After the gas is continuously exhausted from the vacuum vessel until the pressure within the vacuum vessel is reduced to $3\times10^{-6}$ Pa, benzonitrile is introduced into the vacuum vessel through a slow leak valve fitted to the vacuum vessel. The slow leak valve is adjusted in such a manner that the pressure within the vacuum vessel, that is, the pressure of benzonitrile becomes $1.3\times10^{-4}$ Pa.

Figure 10:
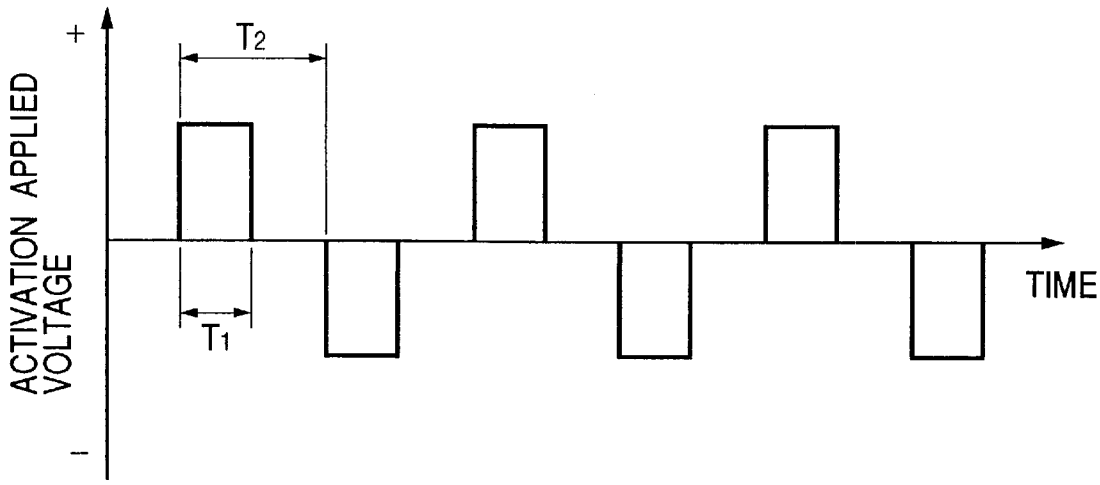
FIG. 10 is a waveform diagram showing pulse voltages used in an activation step in manufacturing the electron-emitting device in accordance with the embodiment of the present invention.

Then, the pulse voltages are applied between the device electrodes 2 and 3. The waveforms of applied pulses are of rectangular pulses, the polarity of which are inverted every pulse as shown in FIG. 10. The pulses are applied for 60 minutes under the conditions where the pulse width Ti is 1 msec., the pulse interval T2 is 100 msec., and the pulse peak is 15 V. (A period of time where the pulses are applied is a period of time which has been obtained through a preliminary study in advance as a period of time required until an increase in the device current is saturated under the above operation conditions.)

Figure 3D:
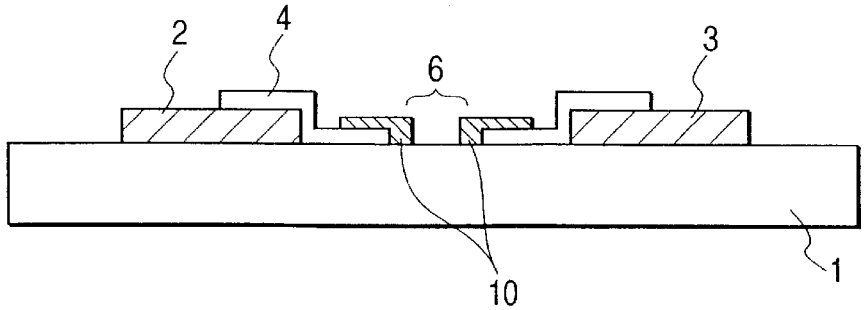

The deposit 10 mainly containing carbon is formed in a region including the fissure 5 formed in the electroconductive film through the above operation. The deposit 10 mainly containing carbon is deposited so as to form a gap 6 narrower than the fissure 5 within the fissure 5 (FIG. 3D).

(Step-f)

The device is extracted to the external of the vacuum vessel, and an operation for permitting Pb to be contained in the deposit 10 mainly containing carbon is conducted.

After the aqueous solution of ethylene-diamine-tetraacetic acid and Pb salt (Pb-EDTA) is coated on the device and then dried, a heat operation is conducted at 200° C. in vacuum. In this situation, the amount of Pb is controlled by adjusting the amount of coated aqueous solution of Pb-EDTA.

There were prepared a sample in which the amount of Pb to carbon is 1 mol % (First Example), a sample in which the amount of Pb to carbon is 3 mol % (Second Example), a sample in which the amount of Pb to carbon is 5 mol % (Third Example) and a sample in which the amount of Pb to carbon is 7 mol % (Comparative Example 2). In addition, for comparison, a sample to which no Pb is added (Comparative Example 1) was also prepared.

The relation between the coated amount and the Pb content has been obtained through a preliminary study in advance. In this case, the content of PB was measured through the photo-electron spectrum method. The measuring device used is ESCA LAB 220I-XL made by VG Scientific Corp.

The measurement was made in such a manner that the ratio of Pb/C was obtained from 4 f peaks of Pb and is peak of C (carbon) which were measured from a region having one side of 50 $\mu$m with the center of the fissure portion. The measurement limit of Pb under the above conditions is about 0.1 mol %.

(Step-g)

Subsequently, the above device is set within the vacuum device again, the gas is exhausted from the vacuum vessel, and the vacuum vessel and the device are held at 250° C. for 10 hours. This operation is to remove water and organic material molecules adsorbed within the device or the vacuum vessel, which is called "stabilization operation".

Figure 4:
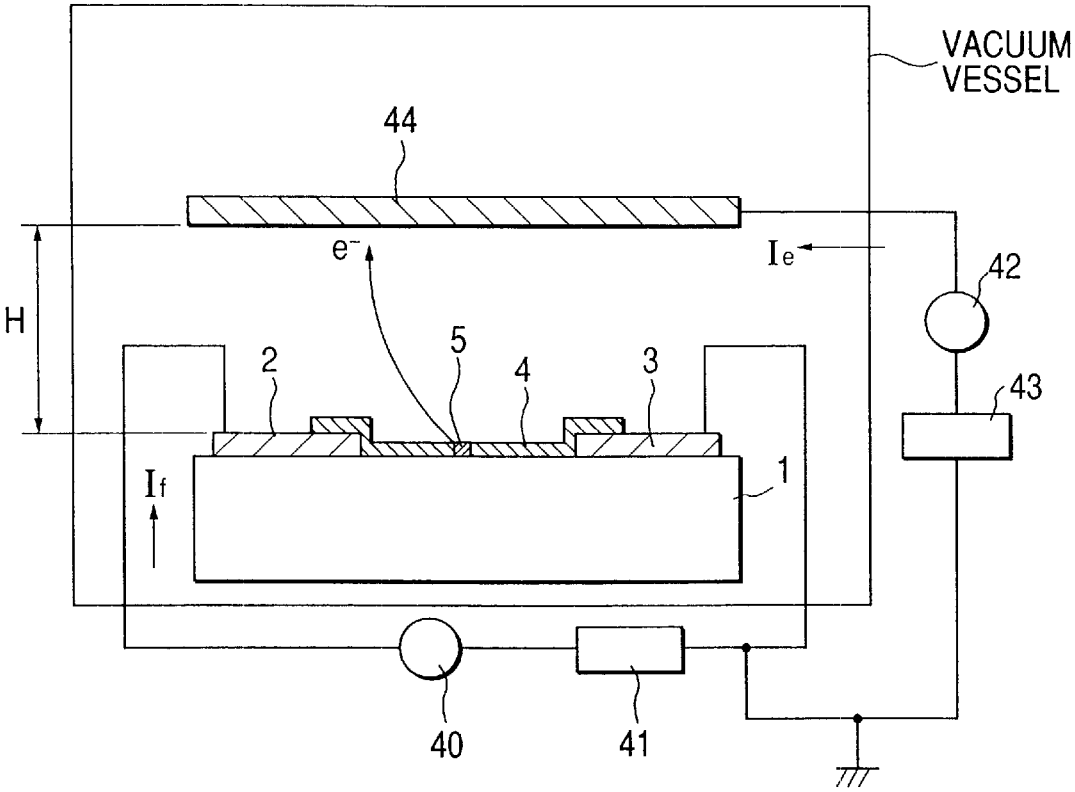
FIG. 4 is a block diagram showing the outline of an evaluating device for the electron-emitting device in accordance with the embodiment of the present invention.

The electron-emitting characteristics of the device and a change of the electron-emitting characteristics with a time were measured by using a device roughly shown in FIG. 4.

In other words, a rectangular pulse 1 msec. in pulse width, 100 msec in pulse interval and 15 V in peak value is applied to the device by a pulse generator 41. In this example, an interval H between the device and an anode electrode 44 was set to 4 mm. A constant voltage of 1 kV is applied to the anode electrode 44 by a high voltage source 43. In this situation, the device current If is measured by an ammeter 40 and the emission current Ie is measured by an ammeter 42, respectively to obtain the electron emission efficiency $\eta$=(Ie/If).

As the device continues to be driven, both of Ie and If are gradually lowered. However, it has been found that when the content of Pb is increased to some degree, Ie and If are quickly lowered as compared with those in a case where Pb is not contained. The comparison of the value of the electron emission efficiency in an initial measurement state with a state where Ie and If are lowered is represented in Table 1.

TABLE 1

| | Comparative Example 1 | Example 1 | Example 2 | Example 3 | Comparative Example 2 |
|---|---|---|---|---|---|
| Pb/C (mol %) | 0 | 1.0 | 3.0 | 5.0 | 7.0 |
| $\eta$(%) | 0.12 | 0.14 | 0.15 | 0.15 | 0.15 |
| Change with Time | — | ○ | ○ | ○ | x |

In Table 1, ○ represents that the status in which Ie and If are lowered is not different from the sample (Comparative Example 1) in which Pb is not contained, and x represents that Ie and If are lowered higher than those in Comparative Example 1.

(Embodiment of Electron Source and Image-Forming Apparatus)

A plurality of electron-emitting devices according to the above-described embodiment or example of the present invention are disposed on a substrate, and wirings are formed on those devices, thereby being capable of forming an electron source.

Figure 6:
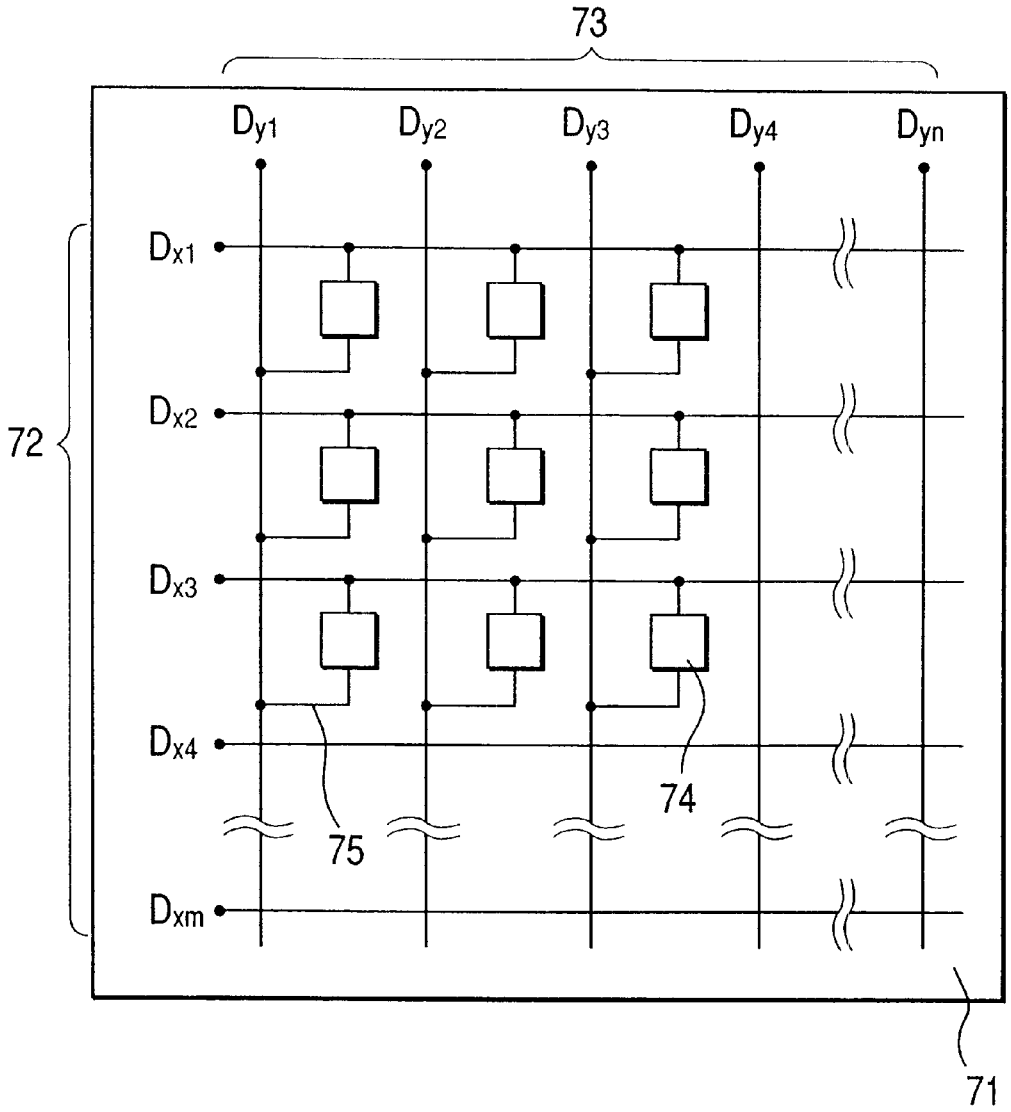
FIG. 6 is a schematic diagram showing an electron source in accordance with the embodiment of the present invention.

An example of the structure is shown in FIG. 6. In the figure, reference numeral 71 denotes a substrate, 72 is m X-directional wirings Dxl to Dxm, 73 is n Y-directional wirings Dyl to Dyn, 74 is electron-emitting devices according to the embodiment or example of the present invention, and 75 is wirings that connect the above wirings to the devices. Also, unrepresented insulating layers are disposed at the crossing portions of the X-directional wirings and the Y-directional wirings so as to electrically insulate the X-directional wirings and the Y-directional wirings from each other.

Also, an image-forming apparatus can be structured by the above electron sources and an image-forming member that forms an image with irradiation of electrons emitted from the electron sources.

Figure 7:
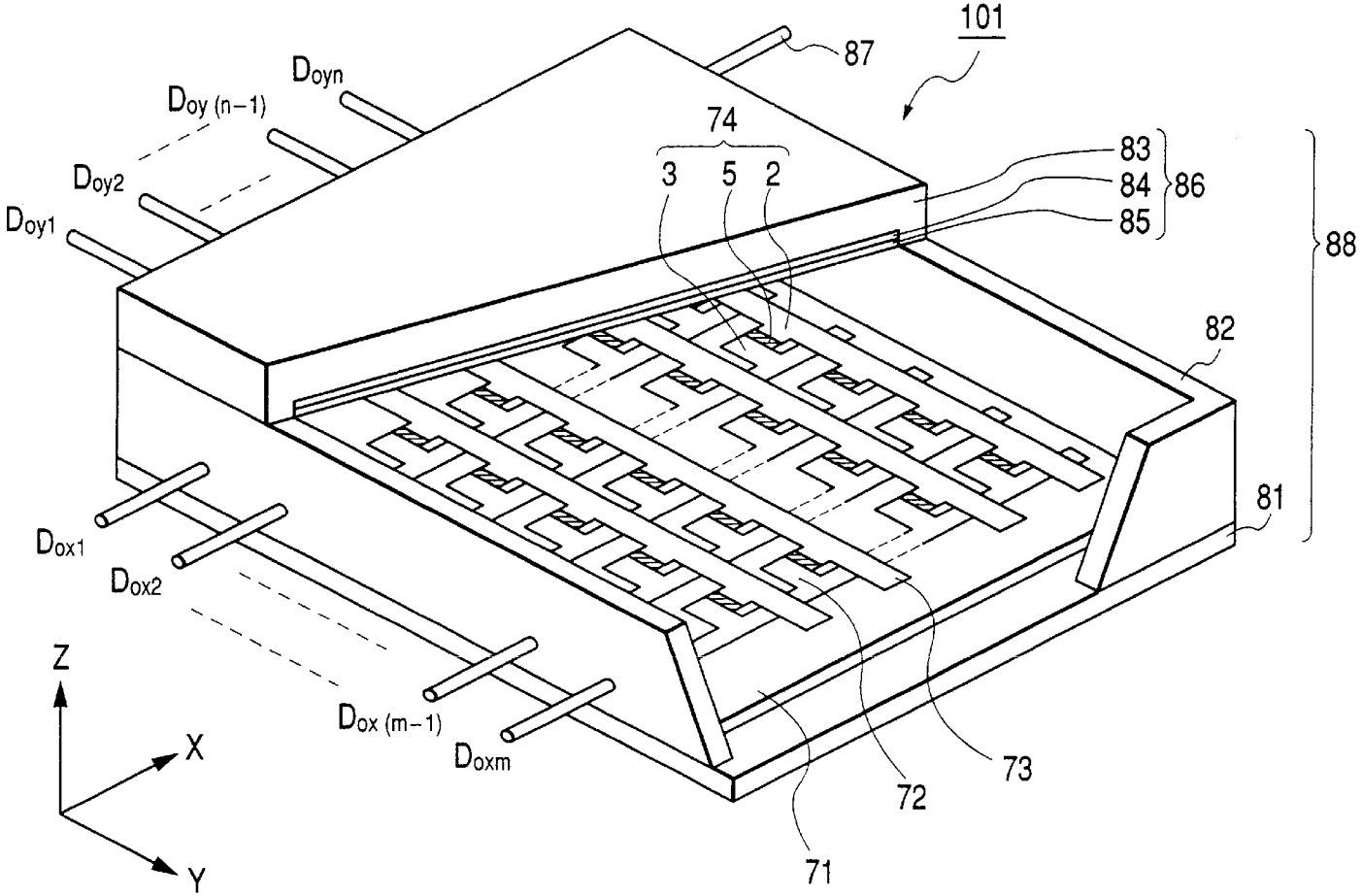
FIG. 7 is a perspective view schematically showing an image-forming apparatus using the electron source shown in FIG. 6 being partially broken.

An example of the structure is shown in FIG. 7. Reference numeral 81 denotes a rear plate, 82 is a support frame, 83 is a glass substrate, and 86 is a face plate, and those members constitute an envelope 88. The above-described electron sources are disposed inside of the envelope 88, and the interior of the envelope 88 is air-tightly held by the envelope 88.

Doxl to Doxm and Doyl to Doyn represent external terminals which are connected to the X-directional wirings Dxl to Dxm and the Y-directional wirings Dyl to Dyn, respectively. Reference numeral 84 denotes an image-forming member formed of a phosphor or the like, and 85 is a metal back formed of a metal evaporation film or the like, which reflects light emitted from the image-forming member 84 toward the inside of the envelope 88 to the outside to improve the luminance, and also acts as an anode electrode for accelerating electrons emitted from the electron sources.

Reference numeral 87 denotes a high voltage terminal connected to the metal back 85, which is connected to the power supply for applying a high voltage to the metal back (anode electrode) 85. in the example shown in the figure, the rear plate In 81 and the substrate 71 of the electron source are separately disposed. However, if the substrate 71 has sufficient strength, the substrate 71 may serve also as the rear plate.

Figure 8:
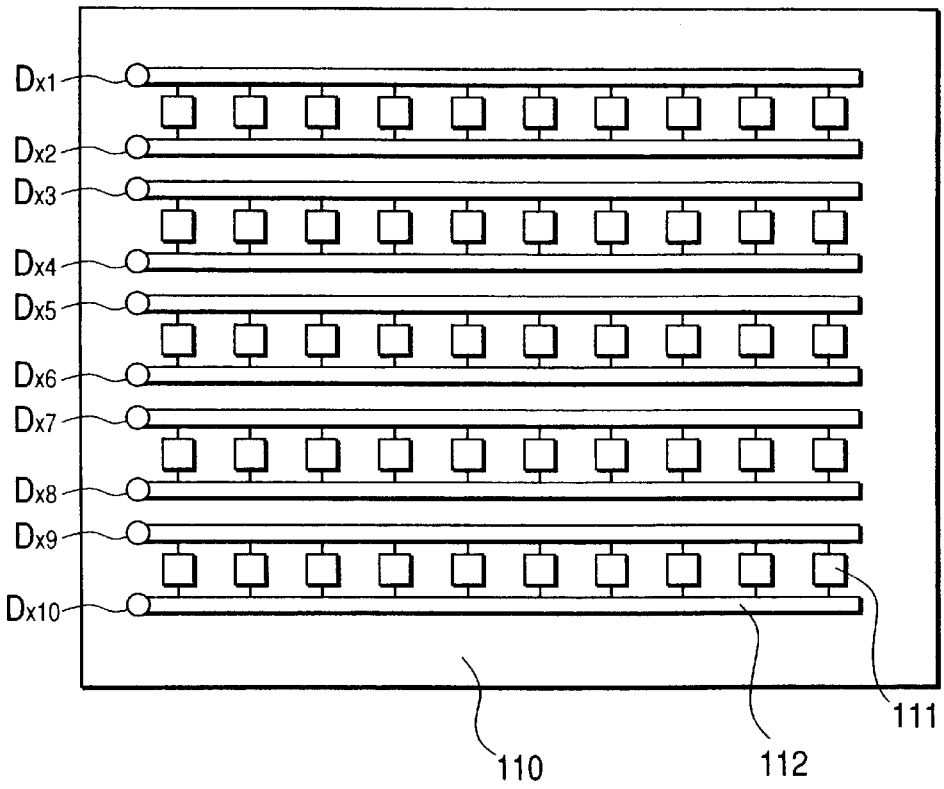
FIG. 8 is a schematic diagram showing another structure of the electron-emitting device in accordance with the embodiment of the present invention.

The structure of the electron sources may be structured as shown in FIG. 8. That is, a plurality of wirings 112 are formed in parallel on a substrate 110, and a plurality of electron-emitting devices 111 are disposed between a pair of wirings to form a plurality of devices in a row.

Figure 9:
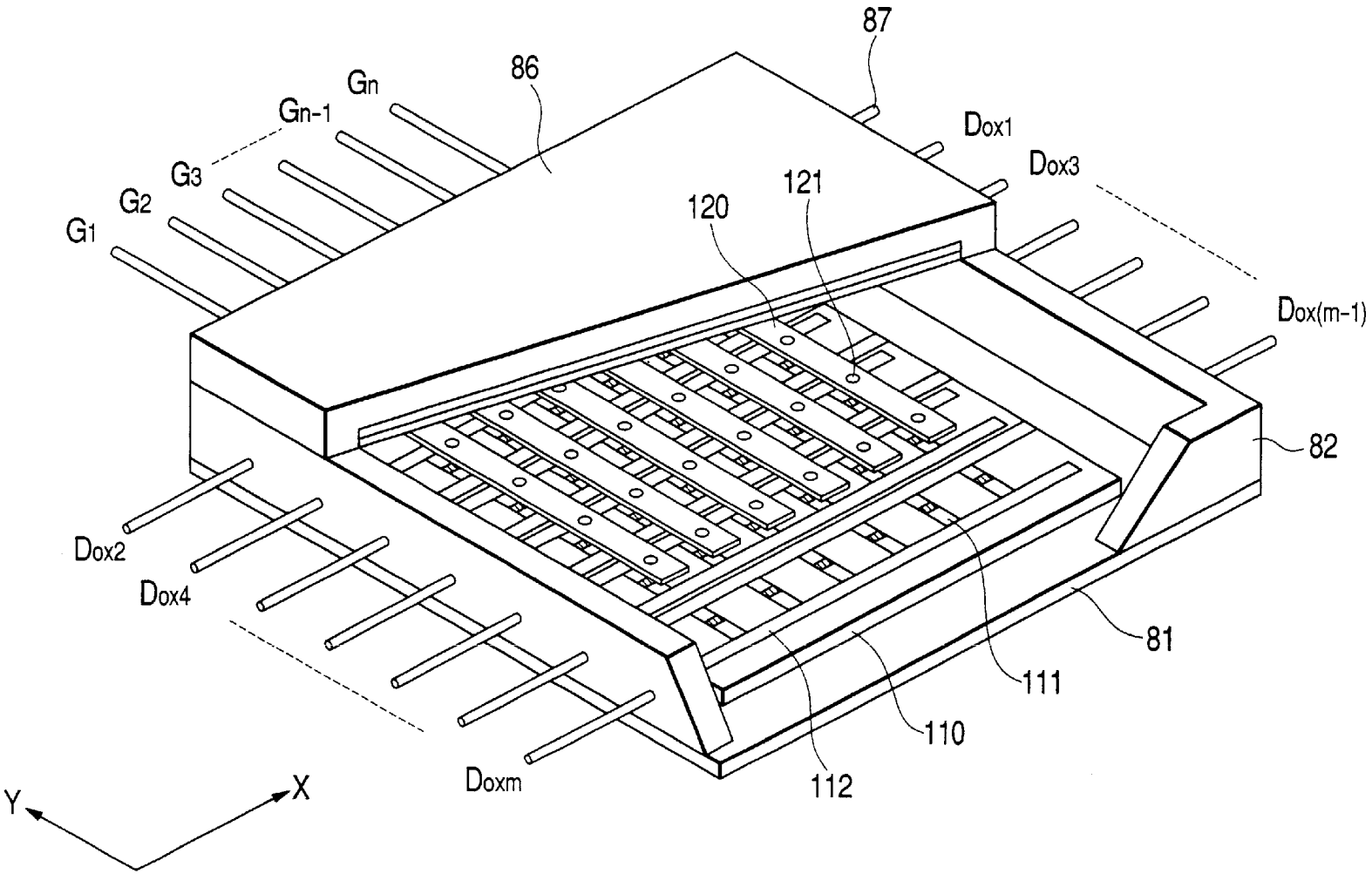
FIG. 9 is a perspective view schematically showing an image-forming apparatus using the electron source shown in FIG. 8 being partially broken.

An example of the structure of the image-forming apparatus using the electron sources thus structured is shown in FIG. 9. In this structure, a plurality of grid electrodes 120 are disposed so as to extend a direction orthogonal to the direction of the device rows of the above electron sources, and function to modulate the electron beam emitted from the electron-emitting device belonging to one row which is selected out of the above device rows by a drive circuit.

Each of the grid electrodes has an electron through-hole 121 through which the electrons pass at a position corresponding to the electron-emitting device.

Doxl to Doxm represent external terminals connected to the above wirings. The figure shows a case in which odd wirings and even wirings are extracted from the side surface of the support frame at the opposite side to the external. G1 to Gn represent grid external terminals connected to the respective grid electrodes.

As was described above, according to the present invention, lead is contained in the deposit films mainly containing carbon in a rate of from 1 mol % to 5 mol % with respect to carbon, as a result of which the electron emission efficiency can be improved without no adverse influence of a change with a time due to driving.

What is claimed is:

1. An electron-emitting device comprising:

a pair of electroconductors disposed on a substrate so as to face each other; and a pair of deposit films connected to the pair of electroconductors, respectively, disposed with a gap therebetween and containing carbon as a main component, wherein lead is contained in said deposit films in a ratio of from 1 mol% to 5 mol% with respect to carbon.

2. An electron-emitting device comprising:

a pair of device electrodes disposed on a substrate so as to face each other;

electroconductive films connected to the pair of device electrodes and having a fissure between the pair of device electrodes; and a deposit formed in said fissure and on a region including said fissure, having a gap narrower in width than that of said fissure within said fissure and containing carbon as a main component, wherein lead is contained in said deposit in a ratio of from 1 mol% to 5 mol% with respect to carbon.

3. An electron source comprising:

a plurality of electron-emitting devices which are disposed on a substrate, each electrode-emitting device being an electron-emitting device as claimed in claim 1; and wirings connected to said electron-emitting devices.

4. An image-forming apparatus comprising:

an electron source as claimed in claim 3; and an image-forming member for forming an image by collision of electrons emitted from said electron source.

5. An electron source comprising:

a plurality of electron-emitting devices which are disposed on a substrate, each electrode-emitting device being an electron-emitting device according to claim 2; and wirings connected to said electron-emitting devices.

6. An image-forming apparatus comprising:

an electron source as claimed in claim 5; and an image-forming member for forming an image by collision of electrons emitted from said electron source.

7. An electron-emitting device comprising:

a carbon film composed chiefly of carbon; and an electrode electrically connected to the carbon film, wherein lead is contained in the carbon film in a ratio of 5 mol% or less with respect to carbon.

8. An electron-emitting device comprising:

a carbon film composed chiefly of carbon; and an electrode electrically connected to the carbon film, wherein lead is contained in the carbon film in a ratio of from 1 mol% to 5 mol% or less with respect to carbon.

9. An electron-emitting device comprising:

a pair of device electrodes disposed on a substrate; and a pair of films connected to the pair of device electrodes, respectively, disposed with a gap therebetween and containing carbon as a main component, wherein lead is contained in said films in a ratio of 5 mol% or less with respect to carbon.

10. An electron-emitting device comprising:

a pair of device electrodes disposed on a substrate;

an electroconductive film connected to the pair of device electrodes and having a first gap between the pair of device electrodes; and a carbon film disposed in the first gap and on the electroconductive film, and having a second gap narrower in width than that of the first gap, within the first gap, and containing carbon as a main component, wherein lead is contained in the carbon film in a ratio of 5 mol% or less with respect to carbon.

11. An electron-emitting device comprising:

a pair of device electrodes disposed on a substrate so as to face each other;

an electroconductive film connected to the pair of device electrodes and having a first gap between the pair of device electrodes; and a carbon film disposed in the first gap and on the electroconductive film, and having a second gap narrower in width than that of the first gap, within the first gap, and containing carbon as a main component, wherein lead is contained in the carbon film in a ratio of from 1 mol% to 5 mol% or less with respect to carbon.

12. An electron source comprising a plurality of electron-emitting devices disposed on a substrate, and wirings connected to said electron-emitting devices, wherein each electron-emitting device is an electron-emitting device according to any one of claims 7 to 11.

13. An image-forming apparatus comprising an electron source according to claim 12, and an image forming member.

14. An electron-emitting device comprising:

a carbon film composed chiefly of carbon; and an electrode electrically connected to the carbon film, wherein lead is contained in the carbon film in a ratio of 1 mol% or more with respect to carbon.

15. An electron source comprising:

a plurality of electron-emitting devices disposed on a substrate; and wirings connected to said electron-emitting devices;

wherein each electrode-emitting device is an electron-emitting device according to claim 14.

16. An image-forming apparatus comprising:

an electron source according to claim 15; and a phosphor.

* * * * *

UNITED STATES PATENT AND TRADEMARK OFFICE

CERTIFICATE OF CORRECTION

PATENT NO. : 6,633,118 B1
DATED : October 14, 2003
INVENTOR(S) : Keisuke Yamamoto et al.

It is certified that error appears in the above-identified patent and that said Letters Patent is hereby corrected as shown below:

Column 2,
Lines 40 and 52, “rate” should read -- ratio --.

Column 3,
Lines 30 and 41, “rate” should read -- ratio --.

Column 4,
Line 44, “material” should read -- materials --.

Column 7,
Line 15, “is” should read -- 1s --.

Column 8,
Line 38, “in” should read -- ¶ In --;
Line 39, after “plate” (close up right margin); and
Line 40, “In 81” should read -- 81 -- and (close up left margin).

Column 9,
Line 1, “rate” should read -- ratio --; and
Line 3, “no” should be deleted.

Signed and Sealed this

Twenty-fifth Day of May, 2004

JON W. DUDAS
*Acting Director of the United States Patent and Trademark Office*